United States Patent [19]

Geurts

[11] Patent Number: 4,557,536

[45] Date of Patent: Dec. 10, 1985

[54] ROTATABLE ELECTRICAL COUPLING

[75] Inventor: Jan V. M. Geurts, Eindhoven, Netherlands

[73] Assignee: U.S. Philips Corporation, New York, N.Y.

[21] Appl. No.: 588,466

[22] Filed: Mar. 12, 1984

[30] Foreign Application Priority Data

Mar. 31, 1983 [NL] Netherlands ..... 8301137

[51] Int. Cl.[4] ..... H01R 39/08

[52] U.S. Cl. ..... 339/8 P; 339/182 R

[58] Field of Search ..... 339/5 R, 5 M, 8 R, 8, 339/91 P, 177 E, 177 R, 182 R, 182 RS, 183

[56] References Cited

U.S. PATENT DOCUMENTS 4,040,696 8/1977 Wada et al. ..... 339/8 R

*Primary Examiner*—Eugene F. Desmond

*Attorney, Agent, or Firm*—Rolf E. Schneider

[57] ABSTRACT

A rotatable electrical coupling comprises a cylindrical housing enclosing two resilient contact members and having a circumferential groove formed in its inner surface. A cable holder has two slip rings respectively cooperating with the two contact members, the slip rings being formed as coaxial cylindrical conductors of different diameters. A connection cable is embedded in the cable holder and has two conducting cores respectively electrically connected to the two slip rings. A hollow substantially cylindrical insulating body electrically separates the two slip rings from each other and includes a disk-shaped member at its end facing the interior of the housing. This disk-shaped member has a diameter greater than the diameter of the larger slip ring and is rotatably journaled in the circumferential groove formed in the housing, an extended leakage path between the two slip rings being thereby provided by the disk-shaped member. The larger slip ring is secured to the outer surface of the insulating body, and the smaller slip ring to the interior of the insulating body.

2 Claims, 7 Drawing Figures

ROTATABLE ELECTRICAL COUPLING

This invention relates to a rotatable electrical coupling comprising a housing enclosing two resilient contact members and a cable holder rotatably secured to the housing and having two slip rings which cooperate with the contact members and are in the form of coaxial cylindrical conductors of different diameters, each slip ring being connected to an electrically conducting manner to a core of a connection cable embedded in the cable holder and the slip rings being electrically separated from each other by an insulating body which includes a disk-shaped member or part whose diameter is greater than the diameter of the larger slip ring and which is rotatably journaled in the housing.

Such a coupling is known from U.S. Pat. No. 4,003,616. The housing may be connected to or form part of an apparatus which during operation has to be able to be rotated to an unlimited extent without the connection cable becoming twisted. This category of apparatus includes, for example, electrical curling irons and handheld hair-dryers equipped with a comb.

The present invention has for its object to provide a coupling of this type, in which the electrical separation between the two slip rings of different diameters is improved and the assembling of the slip rings is simplified and which has very small dimensions.

For this purpose, the coupling according to the invention is characterized in that the insulating body comprises a hollow substantially cylindrical part which extends towards the exterior of the housing for securing the slip rings thereto, the larger slip ring being secured on the outer surface of this part and the smaller slip ring being secured in the interior of this part, and in that the disk-shaped part separates the two slip rings from each other.

Figure 1:
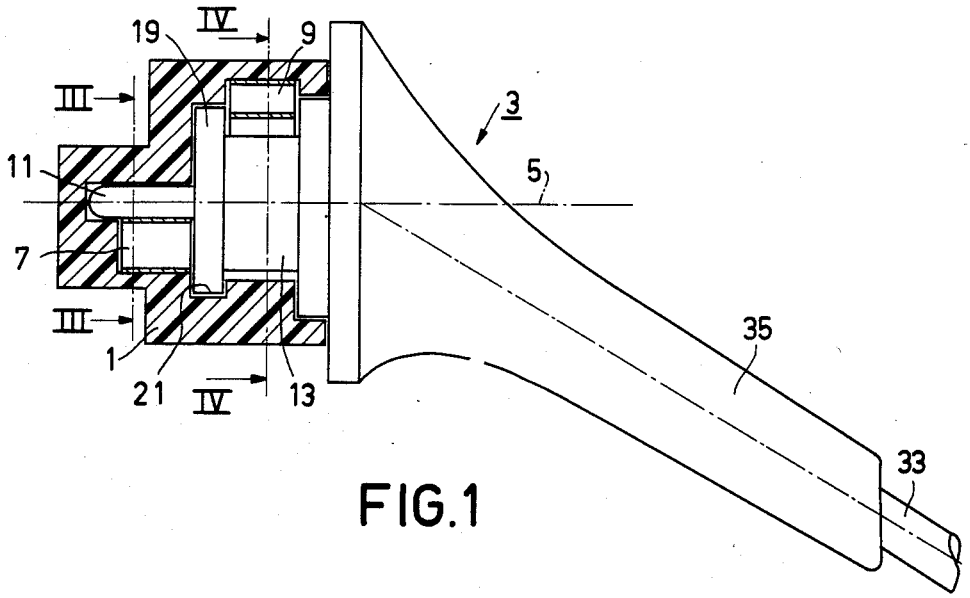
Figure 2:
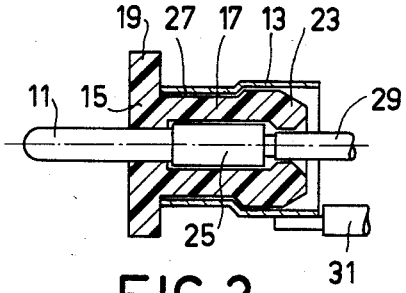
Figure 3:
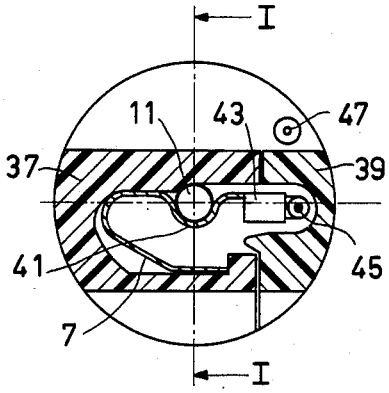
Figure 4:
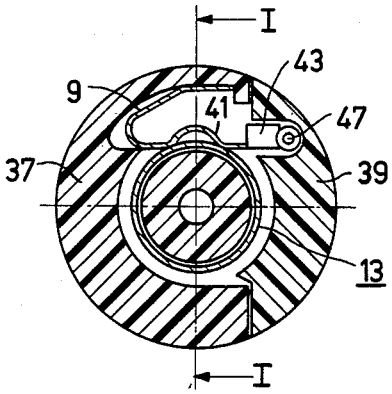
Figure 5:
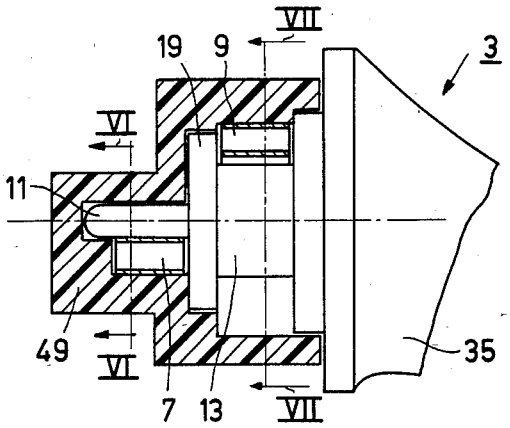
Figure 6:
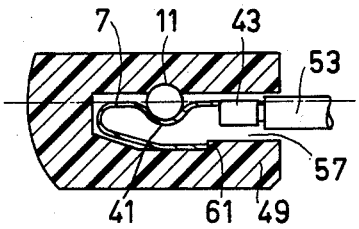
Figure 7:
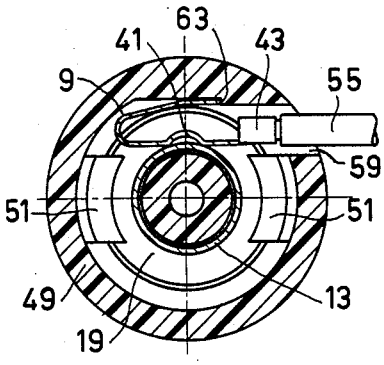

The invention will now be described more fully with reference to the accompanying drawings, in which:

FIG. 1 shows an embodiment of a coupling according to the invention, partly in longitudinal section takes on the line I—I in FIGS. 3 and 4 and partly in side elevation, FIG. 2 is a longitudinal sectional view of a detail of the coupling shown in FIG. 1, FIG. 3 is a sectional view of the coupling shown in FIG. 1 taken on the line III—III in FIG. 1, FIG. 4 is a sectional view of the coupling shown in FIG. 1 taken on the line IV—IV in FIG. 1, FIG. 5 is a view similar to FIG. 1 showing a second embodiment, FIG. 6 is a sectional view taken on the line VI—VI in FIG. 5, and FIG. 7 is a sectional view taken on the line VII—VII in FIG. 5.

The coupling shown in FIG. 1 comprises a cylindrical housing 1 to which a cable holder 3 is secured in such a manner that it can rotate with respect to the housing about an axis 5. The housing 1 accommodates two resilient contact members 7 and 9 wich respectively co-operate with two slip rings 11 and 13 forming part of the cable holder 3.

As illustrated in FIG. 2, the slip rings 11, 13 are constituted by two coaxial cylindrical conductors of different diameters, which are separated from each other by an insulating body 15. The smaller slip ring 11 in this embodiment is a solid pin of, for example, brass, while the larger slip ring 13 is a seamless sleeve, likewise of brass. The insulating body 15 comprises a hollow substantially cylindrical part 17, one end of which is directed away from the interior of the housing 1 (to the right-hand side in FIG. 1). The larger slip ring 13 is secured on the outer surface of this cylindrical part, while the smaller slip ring 11 is secured in the interior of such part. On the side of the insulating body 15 facing the interior of the housing 1 there is provided a disk-shaped part 19, whose diameter is greater than the diameter of the larger slip ring 13. This disk-shaped part 19 has a dual function. First, it constitutes a very effective separation between the two slip rings 11, 13 due to the fact that it makes the leakage path between these slip rings very long. Secondly, the disk-shaped part 19 is rotatably journaled in a circumferential groove 21 formed or recessed in the inner surface of the housing 1 (see FIG. 1) so that a separate journaling of the cable holder 3 in the housing is superfluous, which reduces the number of components and the dimensions of the coupling and simplifies the assembly process.

The slip rings 11, 13 are preferably secured to the hollow part 17 of the insulating body by means of snap connections. For this purpose, an end portion 23 of the hollow cylindrical part 17 remote from the disk-shaped part 19 of the insulating body has a slightly enlarged outer diameter and a slightly reduced inner diameter. The inner slip ring 11 has a portion 25 whose diameter is slightly larger than the inner diameter of the end portion 23 so that, when this slip ring is inserted from the right-hand side, the material of the insulating body is pressed outwards at the area of the restriction formed by the reduced inner diameter of the end portion 23. After the portion 25 has passed through the restriction the insulating body material springs back into its original position so that such slip ring is held within the part 17. The outer slip ring 13 has a part 27 with a diameter which is slighlty smaller than the outer diameter of the end portion 23. This part is held in a similar manner between the end portion 23 and the disk-shaped part 19. The slip rings 11, 13 are connected in an electrically conducting manner to cores 29 and 31, respectively, of a connection cable 33. These connections, together with the end portion 23 of the insulating body 15 and an end portion of the cable 33, are surrounded by a body 35 which is formed by injection-moulding and forms part of the cable holder 3. The material of which the body 35 is made, for example PVC, also migrates into the interstices of the two snap connections so that the slip rings 11, 13 are irremovably connected to the cable holder 3.

The cross-sections shown in FIGS. 3 and 4 illustrate in greater detail the shape of the contact members 7 and 9 as well as the construction of the housing 1. The housing 1 in this embodiment comprises two parts 37 and 39, which are secured to each other, for example, by means of a screw or by ultrasonic welding, after they have been arranged on the cable holder 3 in a manner such that the disk-shaped part 19 of the insulating body 15 is received in the groove 21.

The two contact members 7 and 9 consist of strips of resilient material, for example phosphor bronze, which are each bent approximately into the shape of a U. In one limb of each U there is formed a curved re-entrant portion 41 which is directed towards the other limb and which defines an area or point of contact with the slip rings 11, 13 respectively. At the free end of this limb there is provided a connection tag 43, via which the contact members 7, 9 are connected to conductors 45, 47, respectively. These conductors, which are not visible in FIG. 1 project axially from the housing 1 on the side thereof remote from the cable holder 3 and are connected to an apparatus (not shown) in which the housing is secured or of which the housing forms part. The connection between the connection tags 43 and the conductors 45 and 47 may be, for example, a crimped connection. Due to the fact that the distances between the connection tags 43 and the areas or points of contact of the contact members 7, 9 with the slip rings 11, 13 respectively, defined by the re-entrant portions 41, are very short, the contact members 7, 9 are heated only slightly by the current flowing to the conductors 45, 47 from the respective slip rings. Consequently, current intensities of 10 A or higher are permissable when a temperature increase of at most 45° C. is accepatable. The free end of the other limb of each U resiliently engages the wall of the housing 1 so that the contact members 7, 9 are held between the wall of the housing on the one hand and the slip rings 11 and 13, respectively, on the other hand. The curvature of the re-entrant portion 41 is chosen so that in the case of the contact member 7 this portion contacts the smaller slip ring 11 over at least part of the circumference of this ring. The larger slip ring 13 is contacted by the contact member 9 at two points, namely, at the ends of the respective re-entrant portion 41.

FIGS. 5 to 7 show a second embodiment of the coupling according to the invention, which is distinguished from the first embodiment in that the housing 49 is made in one piece. Components corresponding to those in the first embodiment shown in FIGS. 1 to 4 are designated by the same reference numerals. The housing 49 is provided on its inner surface with two diametrically opposed resilient hooks 51, the distance between the ends of these hooks being slightly smaller than the diameter of the disk-shaped part 19 of the insulating body 15. When the cable holder 3 is inserted into the housing 49 from the right-hand side, the disk-shaped part 19 snaps behind the hooks 51 and the cable holder is thereby rotatably and captively journaled in the housing.

The resilient contact members 7, 9 have the same shape as the contact members of the first embodiment. They are connected to conductors 53 and 55, respectively, which in contrast to the conductors 45, 47 project laterally from the housing 49 through two apertures 57 and 59 in the wall of the housing. The contact members 7 and 9, connected to the conductors 53 and 55, respectively, are inserted into the housing through these openings 57 and 59, respectively, after the cable holder 3 has been secured in the housing 49. On the inner surface of the wall of the housing 49 shoulders 61 and 63 are formed, behind which the free ends of the contact members respectively engage with a snap action when the contact members are inserted into the housing. As a result of this engagement the contact members 7, 9 cannot drop out of the housing.

The housing 1 or 49 may, if desired, be provided on the side remote from the cable holder 3 with resilient hooks (not shown) which operate with a snap action to connect the housing to an apparatus. Of course, the housing may alternatively be secured to the apparatus by any of several other known means, for example, by screws. If desired, such housing may alternatively be formed as a part of the housing of the apparatus.

What is claimed is:

1. A rotatable electrical coupling which comprises a cylindrical housing enclosing two resilient contact members, said housing having a circumferential groove formed in its inner surface; a cable holder having two slip rings respectively cooperating with said two contact members, said slip rings being formed as coaxial cylindrical conductors of different diameters; a connection cable embedded in the cable holder and having two conducting cores, the two slip rings being respectively electrically connected to said two cores; a hollow substantially cylindrical insulating body electrically separating the two slip rings from each other, said insulating body including a disk-shaped member at its end facing the interior of the housing, said disk-shaped member having a diameter greater than the diameter of the larger slip ring and being rotatably journaled in the circumferential groove formed in the housing, an extended leakage path between the two slip rings being thereby provided by said disk-shaped member; means to secure the larger slip ring to the outer surface of the insulating body; and means to secure the smaller slip ring to the interior of the insulating body.

2. A rotatable electrical coupling according to claim 1, in which each slip ring is secured to the insulating body by means of a snap connection.

* * * * *